United States Patent [19]

Colin et al.

[11] Patent Number: 4,798,368

[45] Date of Patent: Jan. 17, 1989

[54] APPARATUS FOR CONTROLLED SLOW COOLING OF STEEL TUBULARS

[75] Inventors: Joseph F. Colin, Darlington; Leo T. Kaercher, Beaver Falls; Charles D. Roberts, Gibsonia, all of Pa.

[73] Assignee: The Babcock & Wilcox Company, New Orleans, La.

[21] Appl. No.: 79,843

[22] Filed: Jul. 30, 1987

[51] Int. Cl.[4] ..... C21D 9/08

[52] U.S. Cl. ..... 266/259; 266/275; 266/280

[58] Field of Search ..... 266/259–260, 266/274–275, 262, 280; 432/83–84, 247–250; 220/201, 215; 294/74 US

[56] References Cited

U.S. PATENT DOCUMENTS

| | | | |
|---|---|---|---|
| 2,305,811 | 12/1942 | Oeckl | 266/259 |
| 2,531,729 | 11/1950 | Gott | 266/262 |
| 3,167,344 | 1/1965 | Applegarth | 294/74 |
| 4,597,564 | 7/1986 | Hanewald | 266/274 |

FOREIGN PATENT DOCUMENTS

| | | | |
|---|---|---|---|
| 14690 | 11/1884 | United Kingdom | 266/262 |

*Primary Examiner*—Christopher W. Brody

*Attorney, Agent, or Firm*—Vytas R. Matas; Robert J. Edwards; Eric Marich

[57] ABSTRACT

Steel tubulars are deposited into an insulated container shortly after the steel tubulars are formed in a seamless hot rolling machine. The tubulars are covered by an insulating blanket and allowed to cool at a selected rate to form desired microstructure in the steel of the tubulars. No external energy supply or controls are necessary to achieve the desired microstructure. The side walls of the container taper outwardly and are made of a sandwiched structure, having spaced apart sheet metal members with a layer of insulation there between. The end walls are similarly constructed. The bottom of the container is lined with granular insulating material to cushion the shock of the tubulars being dropped into the container and to insulate the bottom of the container. Stainless steel mesh is used as a sling and embraces the tubulars to facilitate removing the tubulars from the container after the desired amount of cooling.

8 Claims, 3 Drawing Sheets

APPARATUS FOR CONTROLLED SLOW COOLING OF STEEL TUBULARS

FIELD AND BACKGROUND OF THE INVENTION

The present invention relates in general to the thermal treatment of metals and in particular, to a new and useful method and apparatus for the slow cooling of steel stock, in particular, steel tubulars and bars.

Tubular products of low to medium carbon and alloy grades, ordered for machining applications, must have the proper thermal history to result in the development of a microstructure consisting of blocky ferrite and open lamellar pearlite. This desired condition is developed by controlling the cooling rate during transformation of the austenite phase into the ferrite and pearlite phases. The temperatures of transformation from austenite to pro-eutectoid ferrite vary with chemical composition of the steel and the rate of cooling. The start of transformation may be as high as 1540° F. for a straight low carbon steel, or as low as 1200° F. for an alloy steel. Generally, the start of transformation is between these values for most grades considered for this process. Completion of transformation is also dependent upon chemical composition and cooling rates, and generally ranges between 1300°-750° F. Cooling rates of approximately 60°-100° F./hour are commonly employed industry standard practice for typical slow cool furnace facilities. However, rates as high as 200° F./hour may provide acceptable results on some grades and applications. Cooling rates as low as 20° F./hour or less may be necessary for certain grades and special applications. Generally, the slower the cooling rate to and through the transformation, the better the resultant microstructure.

In the absence of a slow cool furnace, typical cooling rates off the hot mill (approximately 600°-1000° F./hour) result in fine grain ferrite/pearlite microstructures for the carbon and low alloy steels, and in Widmanstatten or martensitic microstructures for the air hardenable grades. Such microstructures do not provide good machinability.

Additional detailed information concerning the thermal treatment of metals can be found in *STEAM/ITS GENERATION AND USE, 39th EDITION,* Published by Babcock and Wilcox.

Quality steel tubular producers have long supplied low to medium carbon and alloy steel tubing to the automotive industry and other end users in a condition considered favorable for subsequent machining on automatic screw machines and/or broaching operations.

One property vital to machinability is the microstructural characteristics of the product. Although order requirements and specifications do not generally stipulate a quantitative acceptance range on microstructure, (other than the limits on surface decarburization), these products, requiring special thermal handling are typically referred to as "blocky ferrite/pearlite" or "open lamellar pearlite".

Most producers take advantage of inherent heat associated with hot rolling, and retard cooling by transporting hot product into a slow cool furnace and by controlling the subsequent cooling rate so as to develop the desired microstructure. Babcock and Wilcox, for example, employed an off mill slow cool furnace at one of its plants for many years. Other plants utilized batch annealing furnaces which required annealing cycles of 32 to 40 hours.

Some plants lacked sufficient off mill space to allow the installation of a slow cool furnace. Therefore, alternate and more costly heat treatments and heat treat facilities are employed to generate the desired microstructural characteristics.

Manufacturing costs associated with the heat treatments, such as batch furnace annealing, pickling (scale removal by acid treatment) surface repair by cold drawing, and the like, add considerably to manufacturing costs.

A need remains for a simple and economical scheme for obtaining the desired microstructures in machinable steel stock.

SUMMARY OF THE INVENTION

The present invention attains the desired microstructure by charging hot rolled tubing directly into specially designed insulated containers that provide the slow cooling rates and cooling profiles necessary to develop the microstructural characteristics favorable to subsequent machining or cold working operations. This is done without many of the undesirable side effects of furnace cooling or annealing, including heavy surface scale and decarburization. The invention is a simple, inexpensive, space saving low maintenance, cost saving, and extremely effective system capable of providing the desired off-mill slow cool furnace or for subsequent heat treating. The production load off the mill can be handled by the system in an area otherwise insufficient to install a slow cool furnace capable of handling a similar production load.

The apparatus of the invention includes a series of specially designed insulated containers into which hot tubing (directly off the seamless tube mill) is conveyed and held until the process of slow cool is completed.

Containers are designed and constructed of steel and insulative materials in such a fashion as to capture the bulk of the thermal energy from the hot tubes, and release that energy by conduction through the container walls and specially designed cover at a rate sufficiently slow to generate the desired blocky ferrite-coarse lamellar pearlite microstructure without the aid of outside heat sources.

The containers have triple wall (insulation sandwiched between steel) ends and side walls. This offers durability and flexibility in the choice of insulative materials that may be employed. Tapered side walls, and cradle type tube inserts facilitate automatic tube stacking and subsequent batch removal of the tubes after completion of the prescribed cooling cycle. The bottom of the container is covered with a layer of shock absorbant insulation such as exfoliated vermiculite.

An insulated lid or blanket is lifted up and down as individual tubes are received into the container. Once the container is filled, the lid is tucked in, to seal the top of the container.

Thermal conditions are monitored by a sufficient number of thermal monitoring devices to allow operations personnel to determine the condition of each container.

The present invention is capable of providing cooling rates as low as 20° F./hour or less. Scale formation and decarburization are no greater than the perhaps less than typical off mill cooled material. Product uniformity is better than typically seen on materials processed through either a slow cool furnace or through subsequent heat treating furnaces.

Advantages of the invention include:

1. Typical microstructures are superior to furnace cooled structures in terms of uniformity and coarseness.

2. Surface scale and decarburization are less than typical of the furnace slow cooled products.

3. The process is relatively inexpensive and passive requiring no external heating source for the controlled cooling cycle.

4. Simplicity yet durability of containers leads to simple and low cost maintenance.

5. System handles large and small diameter, light or heavy wall, and large or small quantity orders equally well.

6. Tubes are extremely straight as cooled and often no additional straightening is required.

The present invention can be applied not only to tubulars, but also to bar stock.

Accordingly, an object of the present invention is to provide a method for treating hot steel stock after it has been milled, comprising: depositing the hot stock into an insulated container which is closeable and which has an insulating characteristic that permits cooling of its contents at a selected rate; closing the container to retain at least some heat of the hot stock in the container; retaining the stock in the container for sufficient time to allow the stock to cool at the cooling rate so as to form a desired microstructure for the steel stock; opening the container; and removing the steel stock from the container.

Another object of the present invention is to provide an apparatus for treating hot steel stock which comprises a container having insulated end, bottom and outwardly tapering side walls with an open top that can be closed by a lid or blanket of insulated material, for containing a stack of steel tubes, rods or bars, after they have been formed in a hot rolling mill for permitting the slow cooling of the steel to produce a desired microstructure in the steel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
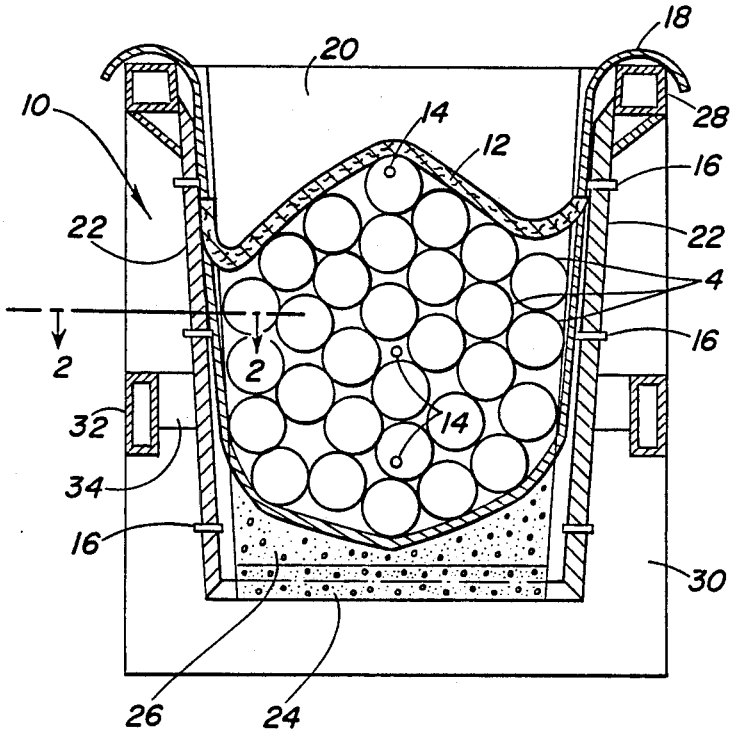
FIG. 1 is a transverse sectional view of an insulated container for the controlled cooling of steel tubulars in accordance with the present invention.

Referring to the drawings in particular, the invention embodied in FIG. 1 comprises a method and apparatus for treating steel stock such as steel tubulars 4 to produce a desired blocky ferrite-coarse lamellar pearlite microstructure therein. Tubulars 4 are formed in a seamless tube hot rolling mill. In accordance with the present invention, immediately after the tubulars are formed, and while they are still red hot and at a temperature range of 1,750° F. to 1,250° F., they are conveyed to and rolled into the open top of a container generally designated 10. Immediately thereafter, the tubulars are covered by an insulating blanket 12. Alternatively, the tubulars are covered by a more rigid lid which also has heat insulating properties.

Additional red hot tubulars are rolled into the container while the blanket or lid is momentarily removed for accepting the tubulars. This continues until the container is filled. Thermo-couples 14 in the end walls of container 10 and thermo-couples 16 in the tapered side walls of the container monitor the internal temperature of the container as the tubulars cool. The insulation of the container, as well as that of the lid or cover, is selected to permit a desired cooling profile for the tubulars. When the temperature inside the container reaches about 1,100° F. or less, the blanket 12 or lid is removed and the tubes can be discharged from the container. One preferred way of removing the tubulars 4 is by lifting them out with stainless steel mesh slings 18 which have ends that are draped over the upper lip of container 10 and which engage under and around the bundle of tubulars 4.

Figure 2:
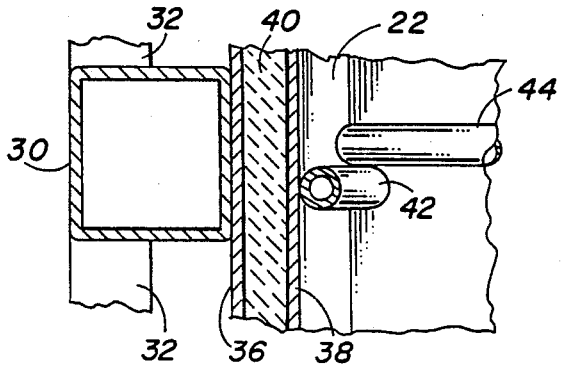
FIG. 2 is a sectional view taken on line 2—2 of FIG. 1, shown on an enlarged scale.
Figure 3:
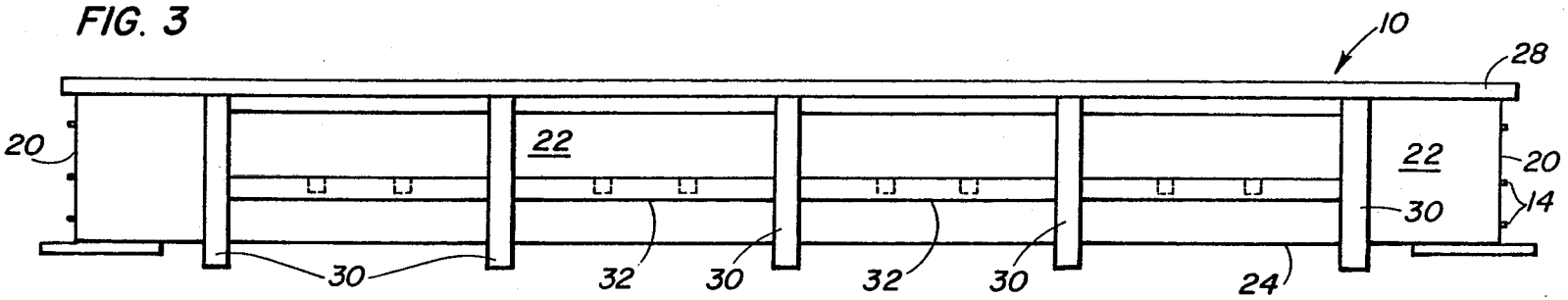
FIG. 3 is a side elevational view of the insulated container of FIG. 1.

Referring now to FIGS. 1 through 3, container 10 comprises a pair of opposite insulated end walls 20, upwardly diverging or tapered side walls 22 which are also insulated, and a bottom wall 24.

The bottom portion of container 10 is filled with granular insulated material which is advantageously vermiculite 26. This acts to insulate the bottom of the container and, at the same time, as a cushion for the tubulars as they are dropped into the container.

The walls of container 10 are supported by a framework comprising an upper rim of square channel defining the rectangular open top of container 10. Rim frame 28 is supported by a number of U-shaped channel frames 30 which engage over the sides and under the bottom of the container. FIG. 3 shows the use of five such U-shaped frames.

Side beams 32 are connected between adjacent U-shaped frames 30. Posts 34 are connected between beams 32 and side walls 22 to brace the side walls of locations between the U-shaped frames 30.

As shown in FIG. 2, each side wall 22 comprises an outer relatively heavy skin 36 of sheet metal, an inner sheet metal liner 38 and an intermediate sandwiched layer of insulation 40.

To protect the liner 38 from dents and other mechanical damage, side tube spacers 42 and bottom tube spacers 44 are provided at spaced locations along the length of container 10. In general, a spacer 42, 44 is provided on the interior of container 10 at the location of each U-shaped frame 30.

In this way, the elongated tubulars 4 rest against the spacers (or at the bottom against the cushion of granular insulation 26) to protect the insulated walls of the container.

The end walls 20 are made of a construction similar to the side walls 22.

The bottom wall 24 is made of a single sheet metal member since the required insulation is provided by the layer of granular insulation 26. Alternatively, a rigid sandwiched structure like that used for the side and end walls can be provided for the bottom wall 24.

The stainless steel mesh 18 can either be provided as a continuous length of mesh which runs the entire length of the container 10, or in discreet lengths of mesh which each lie between adjacent spacers 42, 44. In this embodiment of the invention, the ends of mesh 18, which engage over the rim of the container, can all be connected together, for example, by an elongated rod, for facilitating the removal of the bundle of tubulars from the container.

While any refractory grade insulation can be used for the side and end walls, as well as for the blanket or lid, it is advantageous to use so-called KAOWOOL brand insulation. KAOWOOL is a registered trademark of Babcock and Wilcox.

Figure 4:
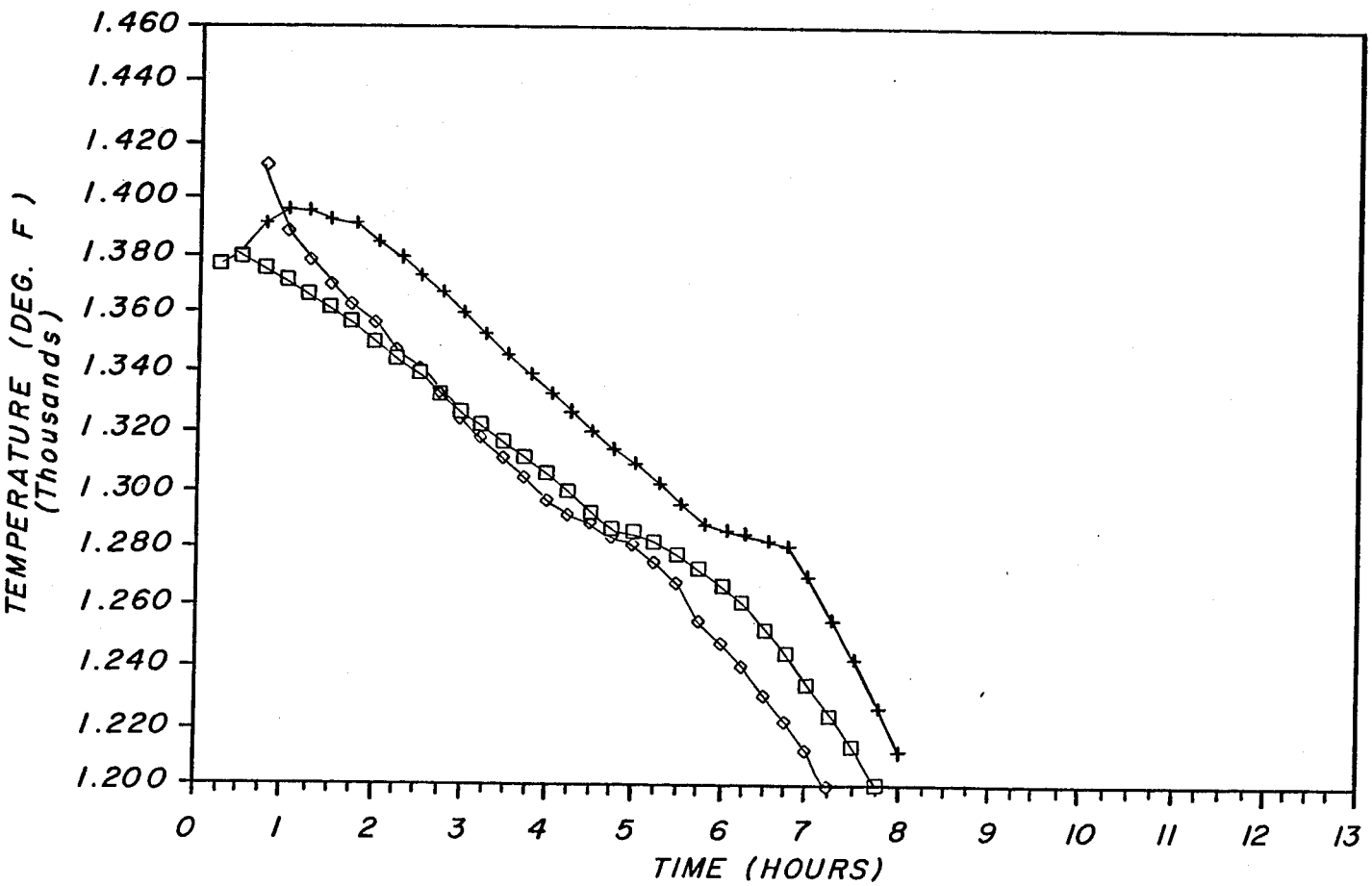
FIG. 4 is a graph showing temperature plotted against time and illustrating a desired cooling profile for metal tubulars to achieve the desired microstructure therefor.

FIG. 4 shows the cooling characteristic curve for three runs of tubulars. Over the course of from seven to eight hours, these tubulars were cooled from 1,400° F. to around 1,200° F. The rate of cooling can be adjusted by carefully selecting the insulating value for the walls of the container. The bundle of tubulars can also be momentarily uncovered and recovered to control the rate of cooling.

It will be understood that not only tubulars, but also bar and rod stock can be cooled in container 10 to achieve desired microstructures therefor. The rate of cooling can be changed to achieve different microstructures.

In either case, the desired microstructures is obtained using no external energy supply. The technique of the present invention is entirely passive, inexpensive and robust. Another advantage is that relatively little space is needed. Little more than the area that is normally allotted for storing the tubulars is required to practice the present invention.

Container 10 can, for example, be about 30′ long for receiving tubulars about that length. The interior of the container can be about 3′ wide and 4′ high.

While a specific embodiment of the invention has been showed and described in detail to illustrate the application of the principals of the invention, it will be understood that the invention may be embodied otherwise without departing from such principals.

The invention claimed is:

1. An apparatus for treating hot steel stock after it is milled, comprising:

a container having insulated side walls, insulated end walls, a bottom wall and an open top;

insulation means in said container over said bottom wall for insulating the bottom of said container;

a flexible, removable blanket of insulating material for covering the open top of said container to cover a load of hot steel stock in said container to control the rate of cooling of the hot steel stock; and sling means lining said container on which steel stock is engagable for facilitating the removal of steel stock from said container.

2. An apparatus according to claim 1 wherein said insulation means comprises granular insulating material at least partially filling a lower portion of said container over said bottom wall for insulating said bottom wall and for cushioning the impact of steel stock dropped into said container.

3. An apparatus according to claim 2, wherein said sling means comprises at least one length of flexible stainless steel mesh lining the interior of said container and having ends extending beyond the open top of said container.

4. An apparatus according to claim 3, including a plurality of spacer means spaced along the interior of said container on which steel stock is engaged for spacing steel stock away from an inner surface of said container.

5. An apparatus according to claim 4 wherein said spacer means comprises tubes extending on the inside of side walls and over a top surface of said bottom wall.

6. An apparatus according to claim 5 wherein said sling means includes a plurality of said lengths of flexible mesh, each positioned between adjacent tubes which form said spacer means.

7. An apparatus according to claim 6 wherein each of said side walls and each of said end walls are made of an outer skin of sheet metal, an inner liner of sheet metal, spaced inwardly of said outer skin, and insulating material filling the space between said outer skin and said liner.

8. An apparatus according to claim 1 wherein said side walls taper outwardly from said bottom wall to said open top of said container.

* * * * *